US007240451B2

(12) United States Patent
Blair

(10) Patent No.: US 7,240,451 B2
(45) Date of Patent: Jul. 10, 2007

(54) TELESCOPE SIGHT MOUNT FOR A FIREARM

(75) Inventor: Brad Blair, Lebanon, OH (US)

(73) Assignee: NTR Group Ventures, LLC, Mason, OH (US)

( * ) Notice: Subject to any disclaimer, the term of this patent is extended or adjusted under 35 U.S.C. 154(b) by 351 days.

(21) Appl. No.: 10/945,790

(22) Filed: Sep. 21, 2004

(65) Prior Publication Data

US 2006/0059762 A1 Mar. 23, 2006

(51) Int. Cl.
*F41G 1/387* (2006.01)

(52) U.S. Cl. ..... 42/124

(58) Field of Classification Search ..... 42/124, 42/127

See application file for complete search history.

(56) References Cited

U.S. PATENT DOCUMENTS

| | | | | |
|---|---|---|---|---|
| 4,008,536 | A | 2/1977 | Adams | |
| 4,328,624 | A | 5/1982 | Ross | |
| 4,383,371 | A * | 5/1983 | Coffey | 42/124 |
| D269,989 | S | 8/1983 | Ross | |
| 4,501,071 | A * | 2/1985 | Manske | 42/127 |
| 4,509,282 | A | 4/1985 | McMillon | |
| 4,597,211 | A | 7/1986 | Miles | |
| 4,890,407 | A * | 1/1990 | Nichols | 42/112 |
| 4,899,479 | A | 2/1990 | Sanders | |
| 4,941,277 | A | 7/1990 | Lawlor | |
| 5,046,277 | A | 9/1991 | Sanders | |
| D322,834 | S | 12/1991 | Lawlor | |
| 5,208,407 | A | 5/1993 | Stover | |
| 5,784,822 | A * | 7/1998 | Korapaty | 42/125 |
| 6,058,615 | A | 5/2000 | Uhlmann et al. | |
| 6,421,946 | B1 | 7/2002 | LoRocco | |
| 6,442,883 | B1 * | 9/2002 | Waterman et al. | 42/124 |
| 6,854,206 | B2 * | 2/2005 | Oz | 42/124 |
| 2004/0000083 | A1 * | 1/2004 | Grant | 42/112 |

* cited by examiner

*Primary Examiner*—Michael J. Carone
*Assistant Examiner*—Bret Hayes
(74) *Attorney, Agent, or Firm*—Ronald J. Richter; Donald E. Hasse; Hasse & Nesbitt LLC

(57) ABSTRACT

The present invention is a telescopic sight mount for attachment to a firearm having a longitudinal vent rib on its barrel. The mount is readily attachable and detachable and includes a cantilevered main body having a front portion and a back portion, a clamp portion, and at least three clamping screws. The screws adjoin the front portion of the main body with the clamp portion and draw the front and clamp portions horizontally towards one another and into rigid clamping engagement with the vent rib. The back portion of the main body is able to receive and mount a telescopic sight. The mount can be rigidly mounted onto the firearm with stability sufficient to remain in place permanently despite recoil, and can also be easily detached from the firearm if desired.

12 Claims, 7 Drawing Sheets

TELESCOPE SIGHT MOUNT FOR A FIREARM

The present invention relates in general to readily attachable and detachable mounting systems for a shotgun or other firearm having a vent rib on its barrel. More particularly, the present invention relates to a mount for a telescopic sight which may be securely attached to and easily detached from a shotgun barrel having a vent rib.

BACKGROUND OF THE INVENTION

Shotgun barrels having ventilation ribs ("vent ribs") have been successfully utilized to provide advantages in sighting and hitting a target with a shotgun. Such vent ribs have been advantageous in that they provide a flat clean sight plane for the shooter to look down and quickly superimpose the barrel onto the target. Also, vent ribs act to better dissipate heat which causes visual distortion after several shots have been fired from the shotgun. Vent ribs are normally the same size for all models and gauges of shotgun made by a single manufacturer. Although there are some shotguns with "odd" sized vent ribs, the majority of vent ribs used on shotguns today fall into a relatively small set of sizes.

While shotguns with vent ribs have been highly advantageous in sports such as trap and skeet shooting, and general wing shooting, such sights do not readily lend themselves to rifle-like accuracy which would be useful in hunting big game and the like. However, in recent years many local governments have become concerned about the use of high-powered rifles in their areas. As a result of these concerns many states and governmental areas have prohibited the use of rifles and have designated "shotgun only" areas for deer hunting. Thus, shotguns are increasingly being used in hunting of big game in areas where traditionally rifles had been used. This situation caused many hunters owning shotguns with vent ribs to buy either a completely new barrel with an attached mount or a completely new shotgun with more rifle-like qualities.

The hunter who already possesses a shotgun for hunting small game which is otherwise adequate does not have, at present, a means for reliably providing that same shotgun with a telescopic sight that can be conveniently installed to be rigidly affixed to the shotgun while in use and then later removed. Therefore, it would be advantageous to provide a superior gun sight mounting system for mounting of telescopic sights and the like to vent rib barrels without loosing accuracy due to repeated firing, thereby reducing the need for a separate shotgun.

Several sighting systems have been proposed in the past for use as attachments for guns. Such sights range from sights which are attached to the receiver of the gun to sights which are attached to vent rib barrels of shotguns. For example, Remington offers a vertically clamping system for attaching a sight to a shotgun that includes a thin plate which fits beneath the vent rib of the gun and four screws that vertically attach the plate to a one-piece clamp. However, this system is not able to reliably clamp the sight strongly due to the thinness of thee plate, which has only a limited number of screw threads for fitting the screws. U.S. Pat. No. 5,337,607 to Klotz for "Sub-base for Top-Mounted Gunsight" describes a sub-base for attaching a telescopic gunsight to the receiver of the gun. The sub-base is permanently and rigidly fastened to the receiver by a set of screws that are screwed into the gun. U.S. Pat. No. 4,008,536 to Adams for "Detachable Gun Sight Mounts" describes a gun sight mount for front and rear sights which may be attached to a shotgun with a ventilated rib sight mount. A pair of readily attachable and detachable gun sight mountings is mounted on the gun, onto which light weight front and rear conventional rifle sights may be mounted.

While the prior art devices may be sufficient for the particular problems that they solve, such sights either involve the permanent altering of the gun, do not produce premium accuracy, are not amenable to mounting of a telescopic sight, and/or do not provide reliable, rigid mounting to withstand jolts from repeated firing. Thus, even with these add-on type sights, the shotgun has not obtained its maximum accuracy.

Further, shotguns which are appropriate for use by younger hunters are generally too heavy for the user when an additional element such as a mount for a telescopic sight is added. Youth guns are generally identical to their larger counterparts with the exception that their stocks have been shortened by approximately one inch. As a result, shotguns for use by youths are shorter but have retained most of the weight of the adult guns. It would be advantageous to provide a high quality telescopic mount that would also be light in weight for a young hunter to use.

It would therefore be advantageous to rigidly yet reversibly attach a telescopic sight to the vent rib of a shotgun. It would also be advantageous to have a mounting system for a shotgun which permits a sight, such as a telescopic sight, to be mounted to the gun in such a way that it can withstand the repeated shocks of recoil without shifting out of alignment. It would also be advantageous to have a detachable telescopic sight mount which may used to attach the sight without modification to the shotgun. Further, it would be advantageous to have a gun sight mounting system which is inexpensive and readily mountable on shotgun vent ribs commonly found in the market. It would also be advantageous for a scope mount for a shotgun to be light in weight and compatible with a high strength, lightweight shotgun, such as an "over-and-under" double barrel shotgun.

SUMMARY OF THE INVENTION

The mounting system of the present invention is a detachable telescope sight mount for a firearm, such as a conventional shotgun that has a longitudinal vent rib on its barrel. The mount includes at least three screws, a cantilevered main body, and a clamp portion. The cantilevered main body has a front portion configured to receive the screws and a back portion configured to receive the telescopic sight. The screws are configured to pass horizontally through the clamp portion and adjoin the clamp portion to the front portion of the cantilevered main body. The screws also draw the front and clamp portions horizontally towards one another and into rigid clamping engagement with the vent rib.

The front portion can include a lip portion, a rib receiver, and a rib support groove. The clamp portion likewise can include a lip portion, a rib receiver, and a rib support groove, so that when the front portion and the clamp portion are tightened together by the screws a T-shaped slot ("T-slot") is formed, such that the vent rib of the shotgun fits rigidly within this T-slot when the mount is attached. Further, a support member of the ventilated rib, i.e. one of the sections of the vent rib that attaches the vent rib to the shotgun barrel, is surrounded by and engaged by the rib support groove. In this way, each of the lip portions engages the underside of the vent rib when the front and clamp portions are drawn together by the screws, each of the rib receivers engage a lateral side of the vent rib when the front and clamp portions are drawn together by the screws, and each of the support grooves engage a rib support member of the vent rib when the front and clamp portions are drawn together by the screws. In an alternative embodiment the mount does not include the rib support grooves, such that the mount can be fitted in between successive rib support members of the vent rib, but could not clamp around a rib support member.

In one embodiment of the invention there can be two dowels extending from the front portion of the main body, each of which mate with a mating hole within the clamp portion. The dowels and the mating holes function to align the front portion and the clamp portion before and during horizontal tightening by the screws. The screws pass through clearance holes in the clamp portion and are received by threaded holes within the front portion of the mount. Tightening the screws into the front portion by way of the threaded holes serves to increase the clamping pressures exerted by the front and clamp portions onto the vent rib, and the screws of the present invention can be designed to exert very large clamping pressures.

The back portion of the main body functions to receive the telescopic sight. To decrease the weight of the mount, which can be made of 304 stainless steel, the back portion can be substantially hollowed out from back to front, and portions of the substantially hollowed-out region also include lightening holes which pass completely through the back portion of the main body to decrease the mass and weight of the mount. The back portion also can include lateral slots cut into its upper surface for receiving locking bolts from a telescope ring assembly, which is known in the art. Alternatively, T-6 aircraft aluminum, anodized to the desired color, can be used for weight reduction, or blued steel can be used for cost reduction.

While the size of the T-slot formed by the combination of the front portion and the clamp portion is compatible with a standard vent rib, there are varying sizes of vent ribs on the market. If the vent rib is larger or smaller than the standard sized T-slot, then the front and clamp portions of the mount can also be manufactured to accommodate the larger or smaller sized vent rib without compromising strength and stability. Alternatively, in another embodiment of the invention, an insert, or shim, can be made available to accommodate a smaller vent rib. The shim provides a certain amount of adaptability to utilize the present invention with a thinner vent rib.

A further understanding of the nature and advantages of the present invention will be more fully appreciated with respect to the following drawings and detailed description, and the scope of the invention will be pointed out in the appending claims.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION OF THE INVENTION

The term "detachable" as used herein refers to an attachment to a vent rib of a shotgun which is removable when such removal is desired. The detachable scope mount of this invention is an intermediate structure that attaches to the gun and to which the gun sight is attached. The terms "scope mount", "telescopic sight mount" and "sight mount" as used herein are interchangeable, and refer to a mount onto which a telescopic sight can be attached and which also can be mounted to a firearm having a vent rib, such as a shotgun.

Figure 1:
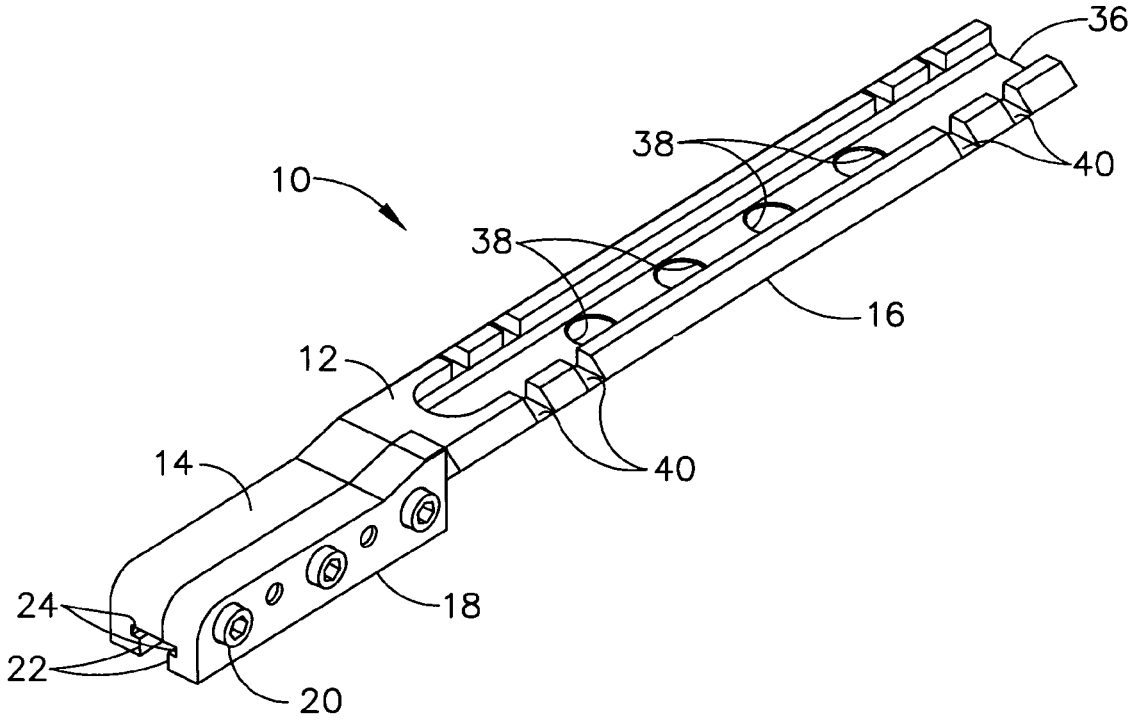
FIG. 1 is a perspective view from the right side of the scope mount of this invention.

Referring now to the scope mount of the present invention shown in FIG. 1 of the drawings, the mount 10 includes a cantilevered main body 12 having a front portion 14 and a back portion 16. The front portion 14 is designed to cooperate with a clamp portion 18. Screws 20 adjoin the clamp portion 18 to the front portion 14. The front portion 14 has a lip portion 22 and a rib receiver 24. The clamp portion 18 likewise includes a lip portion 22 and a rib receiver 24, so that when the front portion 14 and the clamp portion 18 are horizontally drawn together by the screws, a T-shaped slot ("T-slot") is formed (best seen as 42 in FIG. 7).

Figure 2:
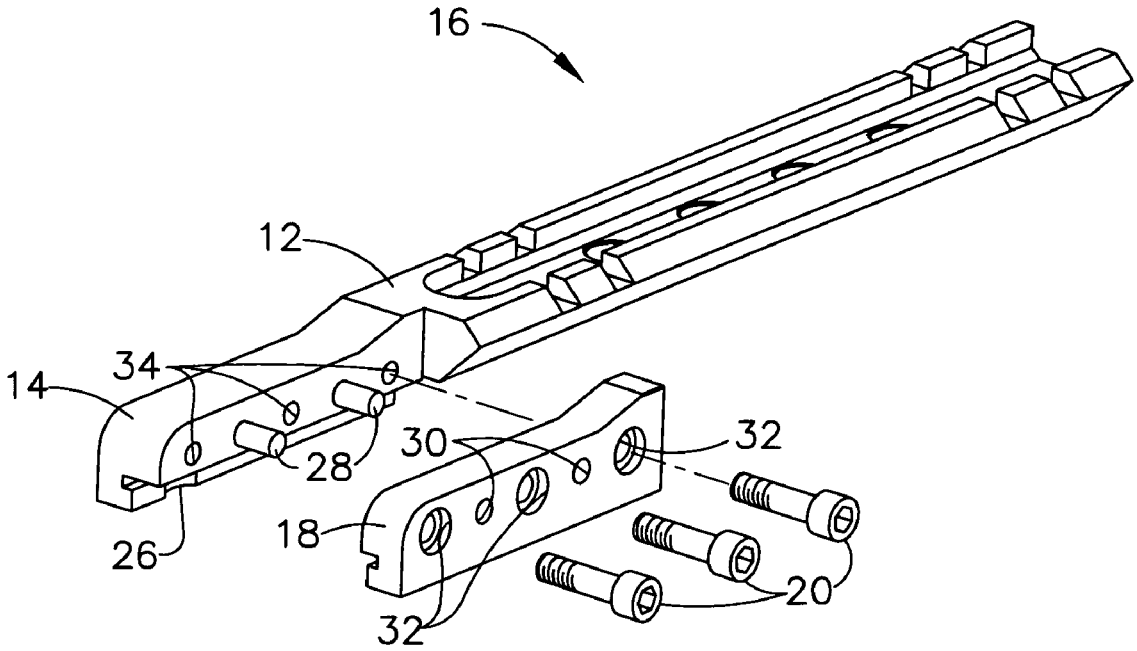
FIG. 2 is an exploded view of the scope mount of FIG. 1.

As shown in FIG. 2 (but better visualized in FIGS. 3 and 4), a rib support groove 26 is located on the underside of the front portion 14 (as well as the clamp portion 18, FIG. 3), which functions to surround and engage a support member of the ventilated rib. Dowels 28 extend from the front portion 14 towards the clamp portion 18, each of which functions to enter a mating hole 30 within the clamp portion. The dowels 28 and the mating holes 30 function to align the front portion 14 and the clamp portion 18 before and during tightening by the screws 20. The screws 20 pass through clearance holes 32 in the clamp portion 18 and are received by threaded holes 34 within the body portion 16.

Looking again at FIG. 1, the back portion 16 of the mount is configured to receive the telescope sight. To decrease the weight of the mount, which can typically be made of 304 stainless steel, the back portion is substantially hollowed out from back to front to include a substantially hollow portion 36. Portions of the substantially hollowed-out region 36 include lightening holes 38 which are shown as circular holes that extend through the back portion 16 of the main body 12 to decrease the mass and weight of the mount. The back portion 16 also includes lateral slots 40 which are formed into its upper surface for receiving locking bolts for one of many types of a telescope ring assembly known in the art.

The front portion 14 of the main body 12 faces the front part of a shotgun (not shown) and clampingly attaches thereto via cooperation with the clamp portion 18 to rigidly engage the vent rib, and the back portion 16 is facing the eye of the shooter and functions to receive a telescopic sight. When tightened, the screws 20 act to secure and maintain the mount 10 in rigid, clamping engagement with the vent rib. Indeed, tightening the screws 20 into the front portion 14 by way of the threaded holes 34 serves to increase the clamping pressures exerted by the front and clamp portions onto the vent rib, and the screws of the present invention can be designed to exert large clamping pressures. In this way, the mount stays in place on the vent rib despite recoil exerted by firing the shotgun, yet the mount can be easily detached when desired.

Figure 3:
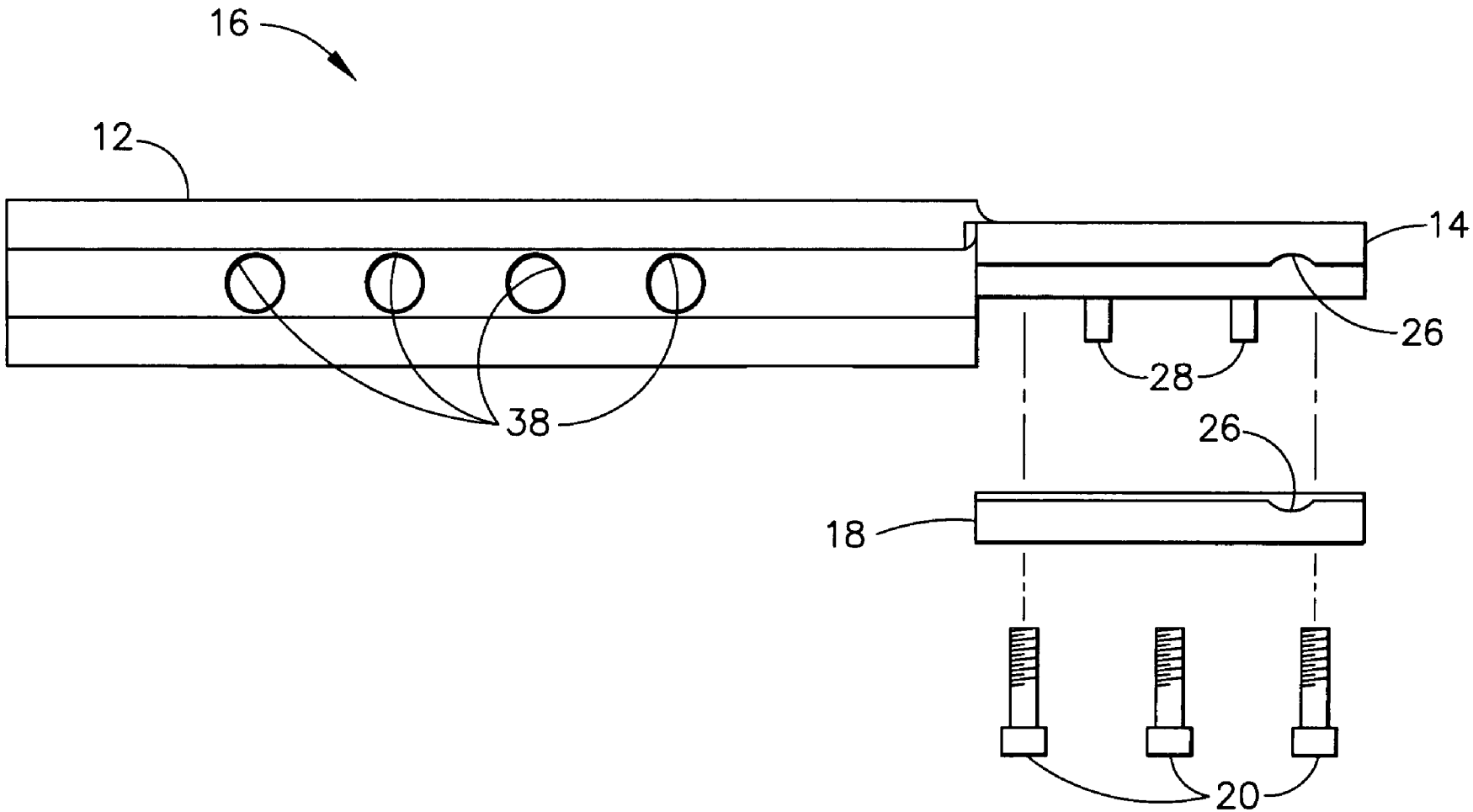
FIG. 3 is an exploded view from the bottom of the scope mount of FIG. 1.

FIG. 3 illustrates an exploded view from the bottom of the scope mount. Note that the front portion 14 and the back portion 16 of the main body 12 are a single unit, with the dowels 28 facing the clamp portion 18. Screws 20 are operable to pass through the clamp portion 18 and screw into the front portion 14, and the dowels 28 enter the clamp portion 18 through the mating holes 30 (FIG. 2). The lightening holes 38 can be seen in FIG. 3 to pass entirely through the main body 12, decreasing the weight of the mount.

Figure 4:
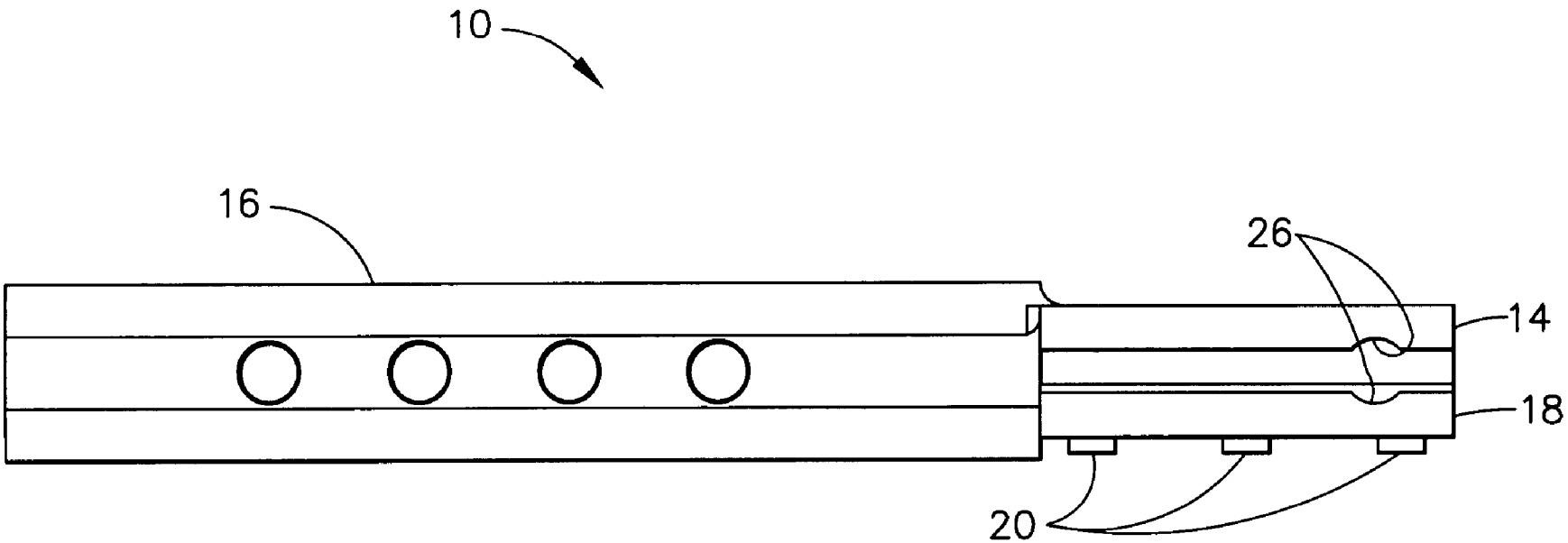
FIG. 4 is a view from the bottom of the scope mount of FIG. 1.

FIG. 4 illustrates a bottom view of the mount after assembly (gun not shown). The screws 20 have been screwed into the front portion 14. Rib support grooves 26 permit a vent rib support member (not shown) to be surrounded and engaged by the cooperation between the front portion 14 and the clamp portion 18. In this manner, the mount 10 of the present invention is not only able to engage the vent ribs of a shotgun via the T-slot 42, but also engage the vent rib support members, thereby providing more rigid stability to the attached mount. Therefore, each of the lip portions 22 engages the underside of the vent rib when the front and clamp portions 14, 18 are drawn horizontally together by the screws 20, each of the rib receivers 24 engage a lateral side of the vent rib when the front and clamp portions 14, 18 are drawn together by the screws 20, and each of the rib support grooves 26 (see FIG. 4) engage a support member of the vent rib when the front and clamp portions 14, 18 are drawn together by the screws 20.

Figure 5:
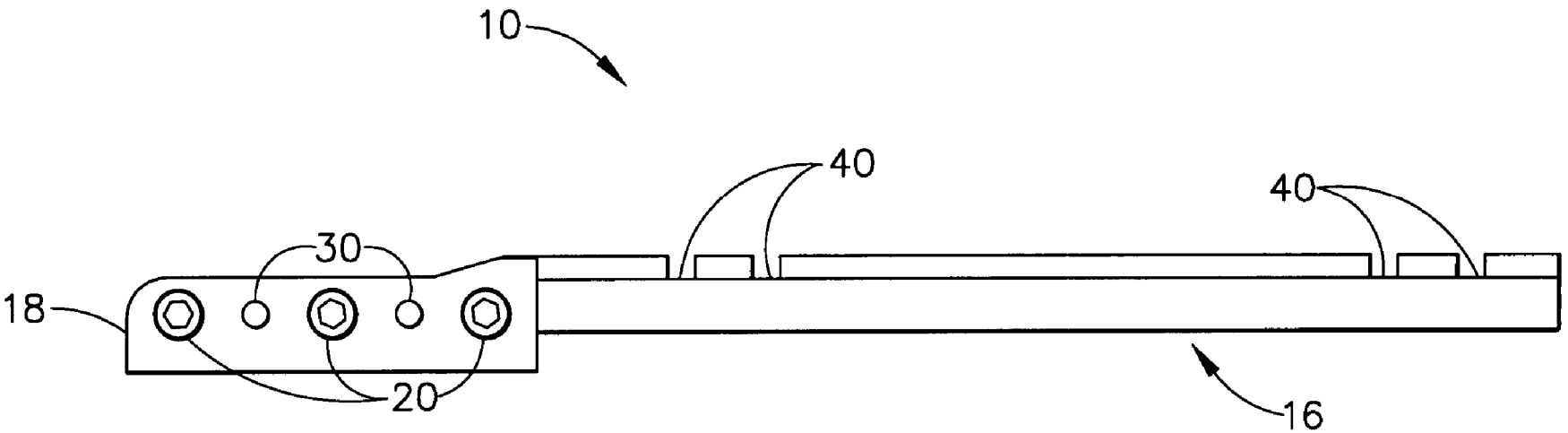
FIG. 5 is a side view from the right side of the scope mount of FIG. 1.

A view of the assembled mount from the right side of the scope mount is shown in FIG. 5. Screws 20 have passed through the clearance holes of the clamp portion 18 and entered the threaded holes of the front portion. Mating holes 30 have received the dowels which extend from the front portion of the main body. In this view, one can appreciate the cantilevered design of the mount, with the combination of the clamping portion 18 and the front portion (not shown) of the main body supporting the back portion 16 of the main body, when assembled. When attached to a shotgun (not shown), the mount will be clampingly engaged to the vent rib, and the back portion 16 will sit atop of the vent rib.

Figure 6:
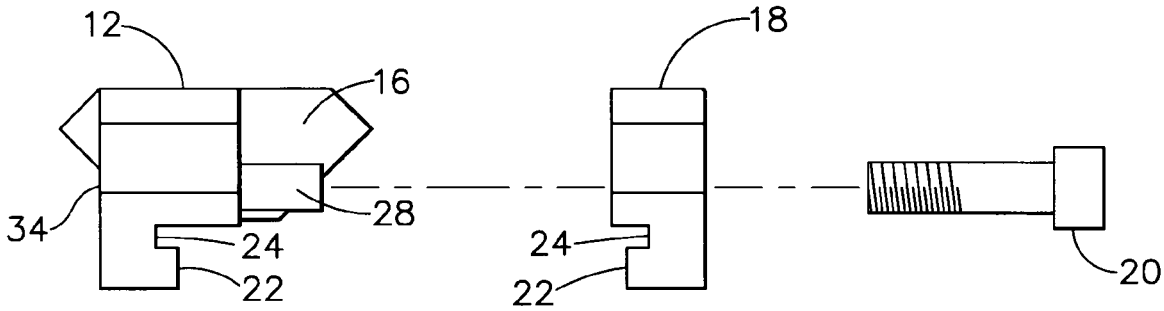
FIG. 6 is an exploded view from the front of the scope mount of FIG. 1.
Figure 7:
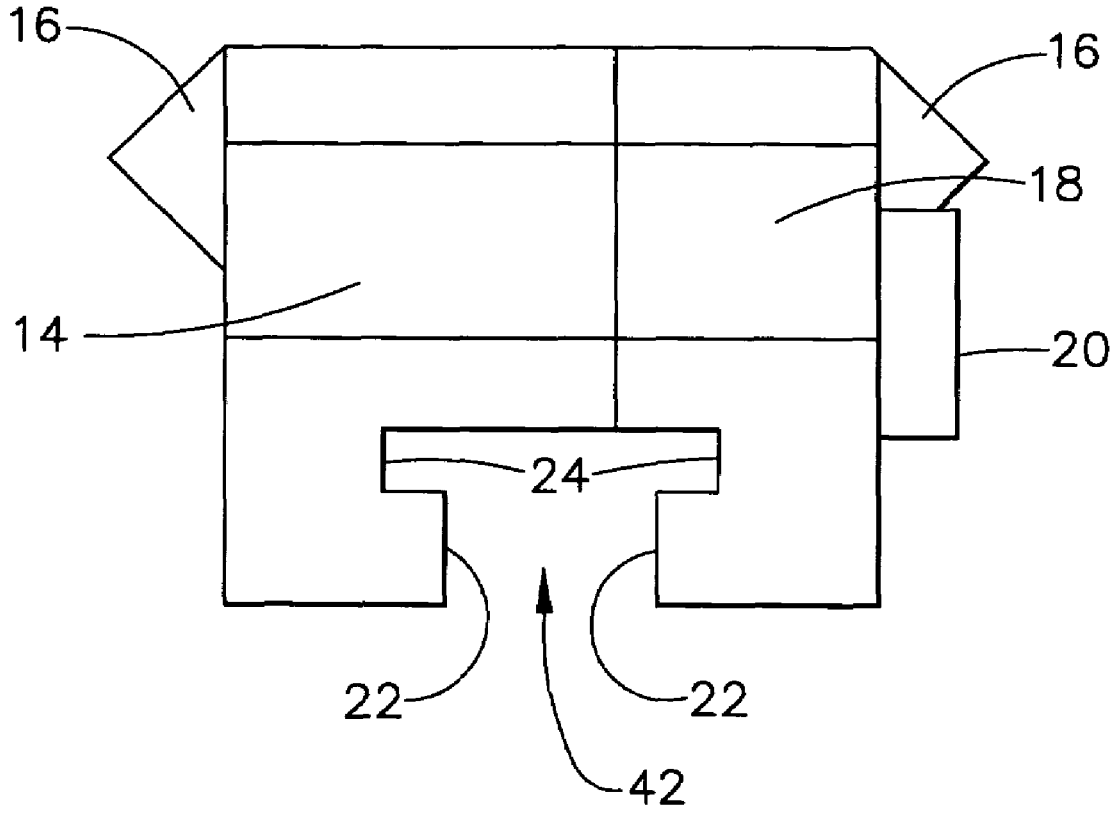
FIG. 7 is a view from the front of the scope mount of FIG. 1.

FIG. 6 is an exploded view from the front of the scope mount of the present invention. The clamp portion 18 and the front portion 14 each have a lip portion 22 and a rib receiver portion 24. The clamp portion 18 receives the dowel 28 which projects from the front portion 14, and screw 20, of which there are three shown, passes through the clamp portion 18 from the other side. When the clamp portion 18 and the front portion 14 are connected, as shown in FIG. 7, a T-shaped slot ("T-slot") 42 is formed. The vent rib of the shotgun fits rigidly within this T-slot 42 when the mount is clamped onto the shotgun, with the two lip portions 22 engaging the underside of the vent rib and the two rib receivers 24 engaging the outside edges of the vent rib. Further, the two rib support grooves 26, as best seen in FIG. 4, will engage the sides of a vent rib support when the mount is clamped onto the shotgun.

In one embodiment of the present invention, the mount 10 not only engages the vent ribs of a shotgun via the T-slot 42, but it also engages the vent rib support members, thereby providing more rigid stability to the attached mount. That is, each of the lip portions 22 can engage the underside of the vent rib when the front and clamp portions 14, 18 are drawn together by the screws 20, each of the rib receivers 24 engage a lateral side of the vent rib when the front and clamp portions 14, 18 are drawn together by the screws 20, and each of the rib support grooves 26 (see FIG. 4) engage a support member of the vent rib when the front and clamp portions 14, 18 are drawn horizontally together by the screws 20. With this many points of attachment, and with screws made sufficiently sturdy with materials known in the art, the mount can exert large clamping pressures onto the vent rib.

In another embodiment of the invention (not shown), the rib support grooves are not present, and the front portion 14 and clamp portion 18 are designed to fit between rib support members of the vent rib and not engage the rib support members. In this embodiment, the front and clamp portions 14, 18 nearly meet beneath the vent rib, but are designed not to physically touch, so that the scope mount can be secured as tightly as possible onto the vent rib of the gun.

One advantage of the sight mount of the present invention is that it can be attached to the shotgun without the need for modification of the shotgun or its associated structures. Further, the mount of the present invention can be adapted to fit most vent rib barrels on the market. The direction of the screws cause the mount to clamp laterally onto the vent rib, eliminating any lateral movement of the mount when securely attached, even during the severe recoil of deer slugs and turkey loads. This confers an advantage over vertically-mounted plate versions, such as that sold by Remington. Further, horizontal, or lateral, clamping allows for deeper threading of the screws as compared to the plate mount of the Remington system, such that the threaded holes allow the screws to extend the full width of the mount itself to allow a large amount of clamping pressure to be applied. The dowels further add to the stability of the mount by precisely aligning the opposing ends of the front portion and the clamp portion.

As best illustrated in FIG. 7, the inner surfaces of the adjoined front 14 and clamp 18 portions forms a T-shape to accommodate the shape of a ventilation rib of a shotgun. The size of this T-slot 42 is designed to be compatible with a standard vent rib; however there are varying sizes of vent ribs on the market. If the vent rib is larger or smaller than the standard sized T-slot, then the front and clamp portions of the mount can also be manufactured to accommodate the larger or smaller sized vent rib without compromising strength and stability. Alternatively, another embodiment of the invention (not shown) can further comprise an insert, or shim, to accommodate a smaller clamping clearance or thinner vent rib. The shim is generally a thin metal plate that is designed to fit between the top of the vent rib and the clamping portion of the mount.

The shim can have a very thin middle section and two notched ends of greater thickness than the middle section. When used, the thickest end of the shim is to be positioned outside the front of the mount, the thin middle section of the shim positioned between the front 14 and clamping 18 portions of the mount and the top of the vent rib, and the other thick end of the shim will extend behind the contact points of the mount and serve to keep the shim from slipping out from under the mount, yet create no clearance issues between the vent rib and the back portion 16 of the mount.

The shim thus can serve to increase the net thickness of the vent rib in order to match the size of the T-slot 42 which has been machined into the parts of the mount, providing a certain amount of adaptability to utilize the present invention with a thinner vent rib. In association with this embodiment, a kit can be manufactured to include a "shim pack" with the manufacture and sale of the mount of the present invention, wherein several different shims of varying middle thickness can accompany each mount.

A variety of materials known in the art can be used to manufacture the scope mount of the present invention, and are typically made from a sturdy material such as metal or steel which will hold its shape during repeated firing. For example, 304 stainless steel can be utilized for strength and extreme resistance to corrosion, as well as creating a nice finish. T-6 aircraft aluminum, anodized to the desired color, can also be used for weight reduction. Blued steel can be used for cost reduction.

While the present invention has been illustrated by the description of embodiments thereof, and while the embodiments have been described in considerable detail, it is not intended to restrict or in any way limit the scope of the appended claims to such detail. Additional advantages and modifications will be readily apparent to those skilled in the art. The invention in its broader aspects is therefore not limited to the specific details, representative apparatus and method, and illustrated examples shown and described. Accordingly, departures may be made from such details without departing from the scope or spirit of the general inventive concept.

What is claimed is:

1. A detachable telescope sight mount for a firearm having a longitudinal vent rib on its barrel, the mount comprising:

at least three screws;

a cantilevered main body having a front portion configured to receive the at least three screws and a back portion configured to receive a telescopic sight; and a clamp portion configured to permit the at least three screws to pass horizontally therethrough, wherein the at least three screws are configured to adjoin the clamp portion to the front portion of the main body and are operable to draw the front and clamp portions horizontally towards one another and into rigid clamping engagement with the vent rib, wherein both the front portion and the clamp portion each include a lip portion and a rib receiver, each of the lip portions configured to engage the underside of the vent rib, each of the rib receivers configured to engage a lateral side of the vent rib, when the front and clamp portions are drawn horizontally towards one another by the screws, and wherein both the front portion and the clamp portion each further include a rib support groove, each of the support grooves configured to engage a support member of the vent rib when the front and clamp portions are drawn horizontally towards one another by the screws.

2. The mount of claim 1, wherein the back portion of the main body includes a substantially hollow portion, at least one lightening hole, and lateral slots for receiving a telescope ring assembly.

3. The mount of claim 1 in combination with a firearm, the firearm comprising a barrel and a longitudinal vent rib on the barrel.

4. A detachable telescope sight mount for a firearm having a longitudinal vent rib on its barrel, the mount comprising:

at least three screws;

a cantilevered main body having a front portion configured to receive the at least three screws and a back portion configured to receive a telescopic sight; and a clamp portion configured to permit the at least three screws to pass horizontally therethrough.

wherein the at least three screws are configured to adjoin the clamp portion to the front portion of the main body and are operable to draw the front and clamp portions horizontally towards one another and into rigid clamping engagement with the vent rib, and wherein the front portion includes at least two dowels and at least three threaded holes, and the clamp portion includes at least two mating holes and at least three clearance holes, each of the at least two dowels being operable to fit into a mating hole to align the front and clamp portions, each of the at least three screws configured to pass through a clearance hole and screw into a threaded hole to draw the front and clamp portions horizontally towards one another and into rigid clamping engagement with the vent rib.

5. The mount of claim 4, wherein the front portion further includes a first rib support groove and the clamp portion further includes a second rib support groove, each of the rib support grooves configured to engage a support member of the vent rib when the front and clamp portions are drawn horizontally towards one another by the screws.

6. The mount of claim 4 in combination with a firearm, the firearm comprising a barrel and a longitudinal vent rib on the barrel.

7. The mount of claim 4, wherein the back portion of the main body includes a substantially hollow portion, at least one lightening hole, and lateral slots for receiving a telescope ring assembly.

8. A detachable telescope sight mount for a firearm having a longitudinal vent rib on its barrel, the mount comprising:

a cantilevered main body including a front portion and a back portion;

a clamp portion; and at least three screws, the clamp portion configured to permit the at least three screws to pass therethrough, the front portion configured to receive the at least three screws, the back portion configured to receive a telescopic sight, the at least three screws operable to adjoin and draw the front and clamp portions horizontally towards one another and into rigid clamping engagement with the vent rib, wherein the front portion includes a first lip portion, a first rib receiver, a first rib support groove, at least two dowels, and at least three threaded holes configured to receive the at least three screws, and wherein the clamp portion includes a second lip portion, a second rib receiver, a second rib support groove, at least two mating holes each configured to receive one of the at least two dowels, and at least three clearance holes each configured to allow one of the at least three screws to pass therethrough, each of the at least three screws operable to screw into the threaded holes of the front portion, each of the lip portions configured to engage the underside of the vent rib, each of the rib receivers configured to engage a lateral side of the vent rib, and each of the support grooves configured to engage a support member of the vent rib when the front and clamp portions are drawn horizontally together by the screws.

9. The mount of claim 8, wherein the back portion includes a substantially hollow portion to decrease the mass and weight of the mount.

10. The mount of claim 8, wherein the back portion includes at least one lightening hole passing completely through the back portion of the main body to decrease the mass and weight of the mount.

11. The mount of claim 8, wherein the back portion includes lateral slots for receiving a telescope ring assembly.

12. The mount of claim 8 in combination with a firearm, the firearm comprising a barrel and a longitudinal vent rib on the barrel.

* * * * *